US007624741B2

(12) United States Patent
Jonckheere et al.

(10) Patent No.: US 7,624,741 B2
(45) Date of Patent: Dec. 1, 2009

(54) MASCARA PACKAGING AND APPLICATOR ASSEMBLY, AND ITS USE FOR APPLYING MAKE-UP

(75) Inventors: Alexandra Jonckheere, Saint Jean le Blanc (FR); Christophe Maniey, Ligny-le-Chatel (FR); Sylvie Bray-Richer, Boigny sur Bionne (FR); Jean-François Tranchant, Marigny les Usages (FR)

(73) Assignee: L V M H Recherche, Saint Jean de Braye (FR)

( * ) Notice: Subject to any disclaimer, the term of this patent is extended or adjusted under 35 U.S.C. 154(b) by 291 days.

(21) Appl. No.: 11/425,552

(22) Filed: Jun. 21, 2006

(65) Prior Publication Data

US 2008/0169000 A1 Jul. 17, 2008

(30) Foreign Application Priority Data

Jun. 24, 2005 (FR) ..... 05 06482

(51) Int. Cl.
*A45D 40/26* (2006.01)

(52) U.S. Cl. ..... 132/218

(58) Field of Classification Search ..... 132/216, 132/218, 313, 317, 320; 401/127, 122, 126, 401/129; 220/608, 370, 371
See application file for complete search history.

(56) References Cited

U.S. PATENT DOCUMENTS

| | | | | |
|---|---|---|---|---|
| 3,204,283 | A | 9/1965 | Damron | |
| 4,231,483 | A * | 11/1980 | Dechenne et al. | 220/608 |
| 4,599,003 | A * | 7/1986 | Schiebelhuth et al. | 366/241 |
| 4,802,797 | A | 2/1989 | Cole | |
| 4,972,858 | A | 11/1990 | Beck et al. | |
| 5,226,744 | A | 7/1993 | Kemmerer | |
| 6,508,603 | B1 | 1/2003 | Vasas | |
| 2005/0196219 | A1 * | 9/2005 | Habatjou | 401/127 |

FOREIGN PATENT DOCUMENTS

DE 38 08 576 2/1989

OTHER PUBLICATIONS

United Kingdom Intellectual Property Office, "*British Search Report*", Oct. 8, 2007, 3 Pages.
French Search Report for FR0506482, dated Mar. 29, 2006, 2 pages.

* cited by examiner

*Primary Examiner*—Robyn Doan
*Assistant Examiner*—Rachel R Steitz
(74) *Attorney, Agent, or Firm*—Miller, Matthias & Hull

(57) ABSTRACT

Mascara packaging and applicator assembly comprising a container with a central axis, a closing device and an applicator head mounted on a rod. The bottom of the container has a central elevation projecting inwards and leaving an annular space between the sidewall of the container and the elevation, the applicator head extending into this annular space when the closing device is closing the opening of the container.

13 Claims, 2 Drawing Sheets

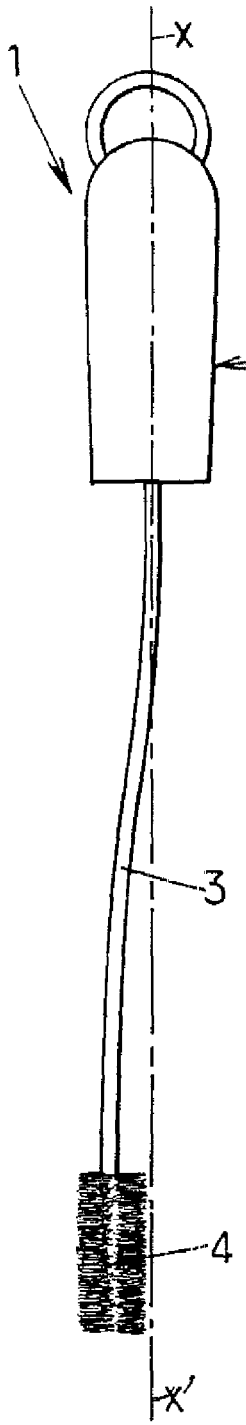
FIG.5.
FIG.4.
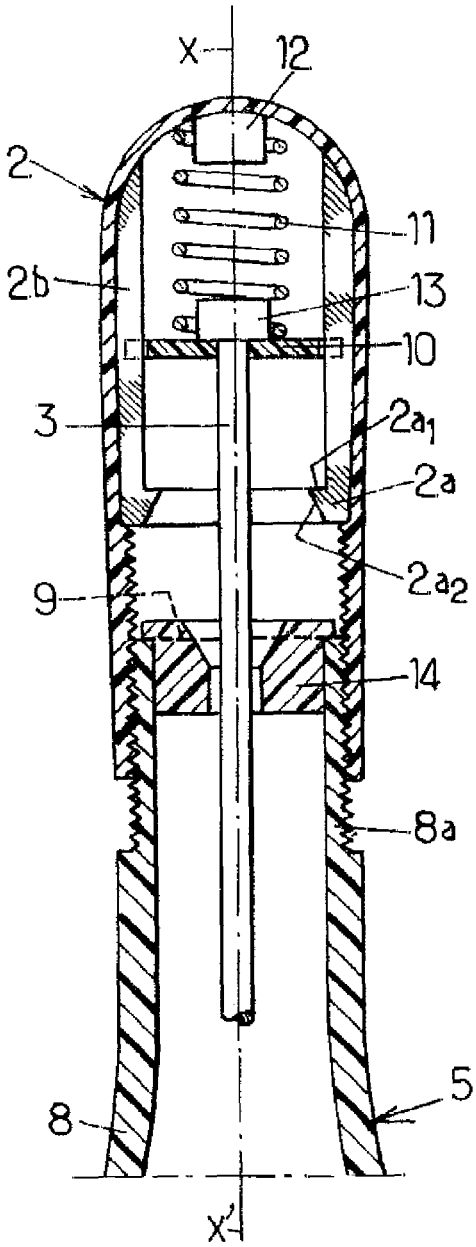

MASCARA PACKAGING AND APPLICATOR ASSEMBLY, AND ITS USE FOR APPLYING MAKE-UP

FIELD OF THE INVENTION

The invention relates to a mascara packaging and applicator assembly The invention also relates to a use of such an assembly for applying make-up, particularly to the eyelashes.

BACKGROUND OF THE INVENTION

Packaging for the application of a mascara, particularly where the latter is a more or less viscous liquid product, requires careful design because on the one hand it has to store the product in a sealed or closed atmosphere in a packaging volume, while on the other hand being capable of dispensing the stored mascara effectively, generally by means of a brush, whenever the user wishes This is particularly difficult to arrange when the mascara to be applied is thixotropic, because in this case, in order to load the brush properly, the mascara has to be stirred to give it sufficient fluidity.

U.S. Pat. No. 6,508,603 discloses a mascara container comprising a wall defining a reservoir. A cap can be placed removably on the neck of the container, while a rod extends from the cap into the container when closed, its position being approximately central with respect to the wall A brush is positioned at the end of the rod furthest from the cap. The brush, which is bent, comprises a first part extending from the central position of the rod, essentially out towards the wall, and a second part, continuing from the first part, which extends down the wall towards the bottom of the container The said first and second parts comprise bristles whose length is adapted to the outline of the reservoir in order to wipe the product off the wall of the said reservoir when the cap is moved to open or close the container.

Although this configuration does allow product present on the wall to be picked up, it has many drawbacks, especially if the product is a thixotropic mascara The problem is that the said brush cannot be loaded efficiently with sufficiently well-stirred mascara This is especially true if there is not much mascara available, since a device of this kind spreads the mascara on the wall as the brush is pulled out of the bottle. With repeated use, the product dries out as it is left on the wall.

Moreover, the dimensions of the container are limited by the dimensions of the brush, so that if it is wished to increase the volume of the container but keep the same configuration, then the container must either be lengthened (in which case the rod becomes very long) or widened (in which case the brush becomes very wide) Either way, the user finds it very difficult to apply the mascara.

It is a particular object of the present invention to alleviate these problems.

SUMMARY OF THE INVENTION

To this end, the invention provides a mascara packaging and applicator assembly comprising:

- a hollow container designed to contain the mascara, comprising a sidewall defining an opening and an internal space, and a bottom, the said hollow container having an essentially central axis passing through the opening,
- a closing device for removably closing the said opening, and
- an applicator head carried by a rod attached to the closing device, the said rod being attached in such a way as to extend generally along the central axis at least in the vicinity of the closing device when the closing device is closing the opening, the said applicator head being attached in such a way as to be in the vicinity of the bottom of the said hollow container when the closing device is closing the opening, characterized in that the bottom has at least one central elevation projecting into the internal space of the hollow container generally along the central axis, leaving an annular space between the sidewall and the said elevation, and in that the said applicator head is arranged and shaped in such a way as to extend, when the closing device is closing the opening, into the said annular space formed between the elevation and the sidewall, to a height such that a major part of the applicator head is situated alongside the elevation.

For the purposes of the invention, the term "mascara" denotes a more or less viscous liquid make-up product for the eyelashes. Such a mascara conventionally contains pigments and is generally thixotropic Because of the structural characteristics of the mascara packaging and applicator assembly described above, it will be realized that when the closing device, to which the rod is attached, is manipulated, the applicator head mounted on the rod moves inside the abovementioned annular space. This manipulation occurs whenever the rod and applicator head are inserted into the said hollow container, whether this happens in the course of their use during application of the make-up or when the said assembly is being opened or closed. Two results are achieved: the movement of the applicator head in the mascara causes an efficient stirring of the product, and the positioning of the applicator head in the abovementioned annular space results in its being charged very satisfactorily with mascara sufficiently fluidized by the stirring.

Notice that the device according to the invention advantageously makes this very satisfactory charging possible even when the quantity of mascara in the said container is small.

The statement that a "major part" of the applicator head is situated next to the elevation means, for the purposes of the invention, that at least 50%, and preferably at least 60%, of the length of the applicator head is next to the elevation.

The assembly according to the invention can also be used to collect or pick up mascara on the applicator head by wiping it against at least part of the elevation and/or at least part of the sidewall and/or at least part of the bottom This is advantageously possible with the invention even when very little mascara is left because the elevation occupies part of the volume of the bottom of the container.

The said assembly allows better stirring and better charging of the product on the brush than with the device of U.S. Pat. No. 6 508 603, without the abovementioned problems, owing particularly to the elevation, which offers an area of contact suitable for efficient stirring of the product during charging. In particular, the volume to be stirred is smaller with the invention, and there is no area within the hollow container where the mascara is not stirred.

In various embodiments of the invention, recourse may optionally also be had to any of the following provisions:

- the said applicator head is designed in such a way that, when the hollow container is closed and opened, it wipes a surface belonging to at least one element chosen from the sidewall, the bottom and the elevation;
- the said applicator head is designed to wipe at least the surface of the elevation;
- the rod has a permanent curvature such that the applicator head is positioned in the said annular space when the closing device is closing the opening;

the rod is straight and has flexibility such that the applicator head rests against the elevation and positions itself in the said annular space by causing the rod to bend when the closing device is closing the opening;

the average distance between the elevation and that part of the sidewall which is opposite it is at least approximately equal to the average width of the applicator head;

the abovementioned average distance, close to the base of the elevation, is preferably approximately equal to the average width of the applicator head;

the height of the elevation is at least 80%, and preferably 85%, of the length of the applicator head;

the closing device is fitted rotatably onto the container and is designed to make the rod rotate;

the closing device is screwed onto the container;

the closing device has an internal space defined between a closed end, or top, and an internally threaded open end;

the rod is mounted on a slider which slides inside the internal space of the closing device in such a way as to remain approximately parallel to the said central axis XX', the slider being prevented from rotating relative to the closing device and urged towards the open end of the closing device by elastic means such as a spring.

The invention further relates to a use of an assembly as defined above for applying make-up, especially to the eyelashes.

BRIEF DESCRIPTION OF THE DRAWINGS

The following description, given by way of non-restrictive example, with reference to the drawings, will explain the invention more clearly and highlight other features and advantages. In the drawings:

FIG. 4 is a partial cross section through the lid as it is being screwed onto the container; and FIG. 5 is a view showing the lid, the applicator head and its supporting rod, all removed from the container, in a second embodiment of the invention.

DETAILED DESCRIPTION OF THE INVENTION

In the various figures, like references denote identical or similar parts.

Figure 1:
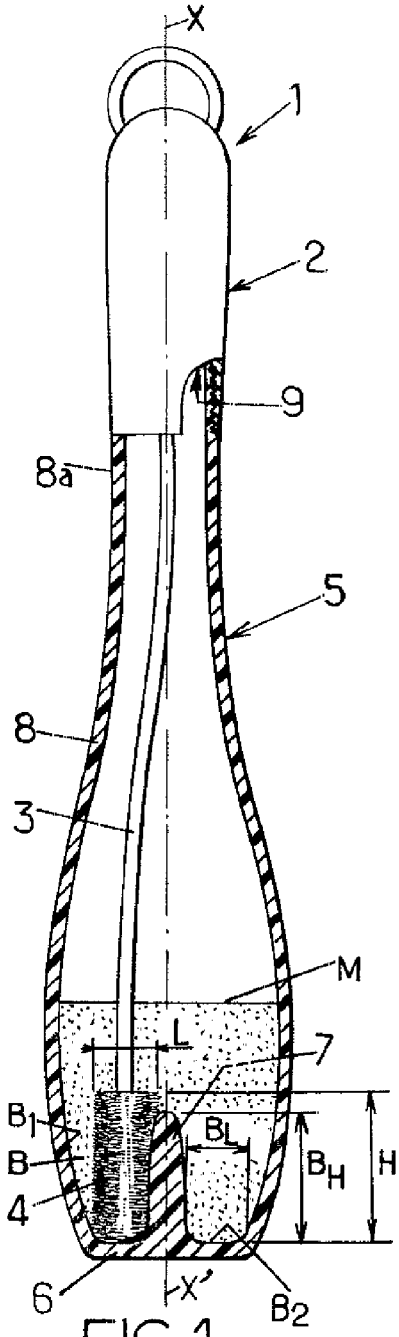
FIG. 1 is a diagrammatic partial cross section through a mascara packaging and applicator assembly in a first embodiment of the invention.

As shown in FIG. 1, the mascara packaging and applicator assembly 1 according to the invention comprises a closing device such as a lid 2 made of plastic or other material, in the general shape of a body of revolution about a central axis X'X to which is attached a rod 3 made of plastic or other material that extends approximately along the central axis X'X.

In the present case the rod 3 is flexible throughout its length (the rod 3 could however be flexible for only part of its length) and may be made of for example an elastomeric or thermoplastic material, selected particularly from the group comprising: a silicone, a fluorosilicone, a butyl rubber or isobutylene/isoprene copolymer, a nitrile rubber or nitrile/butadiene copolymer (NBR), VITON® (DuPont registered trademark), an ethylene/vinyl acetate copolymer (EVA), a polyetheramide block copolymer, an elastomeric polyester, an ethylene-propylene rubber (EPM for copolymers or EPDM for terpolymers that include dienes), a polyurethane, a styrene/ethylene/styrene copolymer (SES), a styrene/butadienestyrene copolymer (SBS), a styrene/isoprene/styrene copolymer, a styrene/butylene-ethylene/styrene copolymer, a synthetic or non-synthetic latex, and a rubber, and blends thereof.

The rod 3 extends lengthwise generally along the central axis X'X as far as a free end to which a mascara applicator head 4 is attached The applicator head 4 in question may here be, for example, a brush with radial bristles (or any other mascara applicator head known to those skilled in the art) of height H measured along the central axis X'X and of width L In addition, the cap 2 is attached, by screwing for example, to a plastic or glass container 5 that has a sidewall 8 extending in the direction of the central axis X'X between:

a bottom 6 comprising a central elevation 7 that projects along the central axis X'X into the internal space of the container 5, and a neck 8*a* defining an opening 9 closed by the cap 2.

The container 5 has symmetry, of revolution or otherwise, about the central axis X'X.

The container 5 contains a supply of mascara M into which the applicator head 4 is dipped when the cap 2 is closing the opening 9 of the container The flexibility of the rod 3 enables it to be bent by the pressure of the applicator head 4 on the central elevation 7 when the cap 2 is placed on the container 5, in such a way that the said applicator head 4 positions itself in the annular space B located between the elevation 7, the bottom 6 and the sidewall 8 of the container, alongside the elevation.

The said annular space B has a height $B_H$ equal to the height of the elevation 7 and a width $B_L$ $B_L$ may vary in width between the bottom and the top of the annular space. The said annular space B is defined internally by the elevation 7, externally by a lower part $B_1$ of the inside surface of the sidewall 8 alongside the elevation 7, and by the upper surface $B_2$ of the bottom 6. The width $B_L$ is preferably approximately equal to or slightly greater than the width L of the applicator head 4. It will be seen that in the example illustrated, the width $B_L$ of the annular space is approximately equal to the width L of the applicator head towards the base of the elevation 7. The height $B_H$ of the elevation 7 may be for example at least 80 %, and preferably at least 85%, of the height H of the applicator head 4

When the cap 2 is in place on the container 5, the applicator head 4 presses:

laterally, against the elevation 7 and against the lower part of the abovementioned inside surface $B_1$ of the sidewall 8, and axially against the upper surface $B_2$ of the bottom 6.

Figure 2:
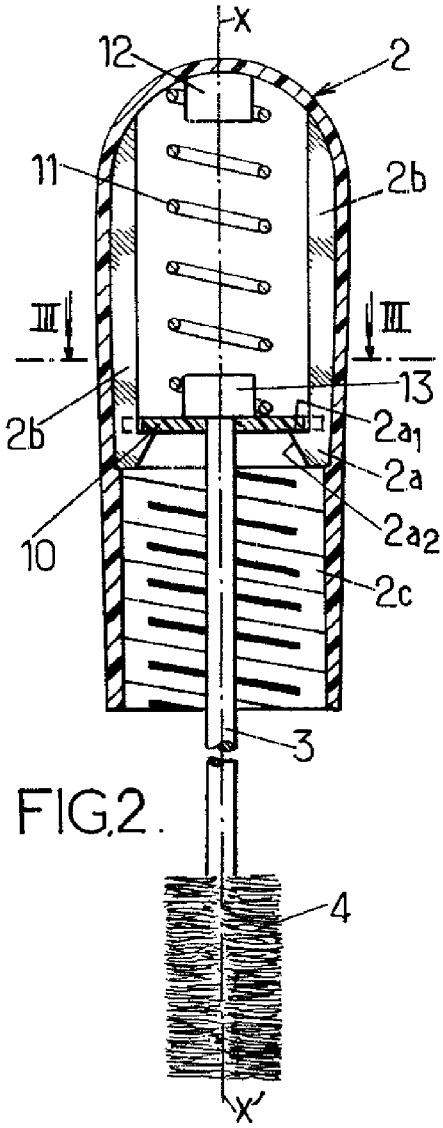
FIG. 2 is a detail view showing the lid of the assembly of FIG. 1, the applicator head and its supporting rod when the lid is removed from the container belonging to the said packaging and applicator assembly.
Figure 3:
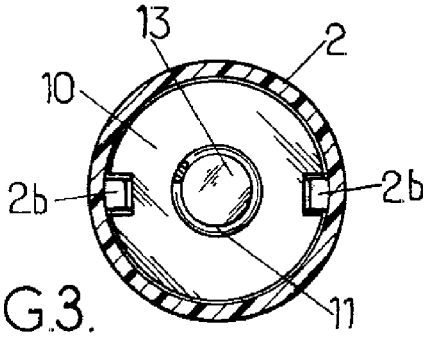
FIG. 3 is a cross section taken on III-III as marked in FIG. 2.

As shown in FIGS. 2 and 3, the cap 2 extends along the central axis X'X between a closed end and an open end, the latter having an internal thread 2*c* screwed onto the neck 8*a* of the container Mounted inside the cap 2 is a slider 10 able to slide unseen up and down the central axis X'X between the closed end of the cap 2 and two or more stops 2*a* located neat but beyond the screw thread 2*c*.

The slider 10 may for example take the form of a piston-like plate with, for example, two notches engaged on two axial ribs 2*b* formed on the inside of the cap 2, so that the sliding movement of the slider 10 is permitted, while at the same time the said slider 10 is not able to rotate about the central axis X'X relative to the cap 2

As can be seen in FIG. 2, when the cap 2 is taken off the container 5, the slider 10 is urged elastically towards the open end of the cap 2, against the stops 2*a* by a spring 11, for example a helical compression spring fitted between the closed end of the cap 2 and the slider 10. One end of the spring 11 may for example be fitted over a first block 12 formed on the inside of the closed end of the cap 2, and the other over a second block 13 integral with the slider 10 and with the rod 3.

In the example illustrated in FIGS. 2 and 3, the stops 2*a* each have an upper limit surface $2a_1$ generally perpendicular to the central axis X'X to obstruct the slider 10, and a lower cam surface $2a_2$ diverging obliquely away in the downward direction, the said cam surface being such as to allow the slider 10 to be engaged on the ribs 2*b* by snap action from the open end of the cap 2.

In addition, as can be seen in FIG. 2, when the cap 2 is taken off the container 5, the elasticity of the rod 3 causes it to become straight again along the central axis X'X The dimensions of the rod 3 can be such that the applicator head 4 comes into contact with the upper surface $B_2$ of the bottom 6 as soon as the cap 2 begins to be screwed onto the neck 8*a* of the container 5, in order that for the whole period during which the cap 2 is being screwed on, the applicator head 4 is rotating in the annular space B and brushing against at least the elevation 7 so as to charge itself with mascara M while simultaneously stirring it, even when there is very little mascara left in the bottom of the container 5

In the course of this movement, as shown in FIG. 4, the slider 10 is moving gradually towards the top of the cap 2, compressing the spring 11 as it goes.

In the same way, when a user unscrews the cap 2 in order to apply the mascara M, the applicator head 4 follows a movement of rotation in the opposite direction around the elevation 7, thereby stirring the mascara M again and becoming charged with mascara.

Again, FIG. 4 shows diagrammatically a scraper 14 for removing excess mascara from the rod 3 and from the applicator head 4 when the rod and applicator head assembly is withdrawn from the container 5

The second embodiment of the invention, illustrated in FIG. 5, is similar to the first embodiment described above and will therefore not be described again in detail here.

This second embodiment differs from the first embodiment of the invention in that the rod 3 is rigid or basically rigid and has a suitable permanent curvature so that the applicator head 4 lies in the annular space around the elevation 7 when the cap 2 is closing the opening 9 of the container In this embodiment, the rod 3 may for example be made of a material chosen from polyethylenes such as the low-density polyethylenes, high-density polyethylenes and blends of polyethylenes of different densities; polyoxymethylenes; polypropylene; poly(vinyl chloride) or PVC; polyesters, polyamides, nylons; and blends of other plastics such as blends of polycarbonate and polypropylene; and blends of these The rigid material of which the rod 3 is made is then preferably polyoxymethylene.

What is claimed is:

1. A mascara packaging and applicator assembly comprising:

a hollow container designed to contain the mascara, comprising a sidewall defining an opening and an internal space, and a bottom said hollow container having a central axis passing through the opening, a closing device for removably closing said opening, and an applicator head carried by a rod attached to the closing device, said rod being attached in such a way as to extend along the central axis at least in the vicinity of the closing device when the closing device is closing the opening, said applicator head extending on a certain height and being attached in such a way as to be in the vicinity of the bottom of said hollow container when the closing device is closing the opening, wherein the bottom has at least one central elevation projecting into the internal space of the hollow container along the central axis, leaving an annular space between the sidewall and a surface of said elevation, and said applicator head is arranged and shaped in such a way as to extend, when the closing device is closing the opening, into said annular space formed between the elevation and the sidewall, such that a major part of the applicator head is situated alongside the elevation, and said applicator head being designed to wipe at least the surface of the elevation.

2. The assembly according to claim 1, in which said applicator head is designed in such a way that, when the hollow container is closed and opened, it wipes a surface belonging to at least one element chosen from the sidewall and the bottom.

3. The assembly according to claim 1, in which the rod has a permanent curvature such that the applicator head is positioned in said annular space when the closing device is closing the opening.

4. The assembly according to claim 1, in which the rod is straight and has flexibility such that the applicator head rests against the elevation and positions itself in said annular space by causing the rod to bend when the closing device is closing the opening.

5. The assembly according to claim 1, in which the average distance between the elevation and that part of the sidewall which is opposite it is at least approximately equal to the average width of the applicator head.

6. The assembly according to claim 5, in which the average distance, close to the base of the elevation, is approximately equal to the average width of the applicator head.

7. The assembly according to claim 1, in which the height of the elevation is at least 80% of the length of the applicator head.

8. The assembly according to claim 1, in which the closing device is fitted rotatably onto the container and is designed to make the rod rotate.

9. The assembly according to claim 8, in which the closing device is screwed onto the container.

10. The assembly according to claim 1, in which the closing device has an internal space defined between a closed end, or top, and an internally threaded open end.

11. The assembly according to claim 10, in which the rod is mounted on a slider which slides inside the internal space of the closing device in such a way as to remain approximately parallel to said central axis, the slider being prevented from rotating relative to the closing device and elastically urged towards the open end of the closing device.

12. Use of an assembly according to claim 1 for applying make-up, especially to the eyelashes.

13. The assembly according to claim 1, in which the height of the elevation is at least 85%, of the length of the applicator head.

* * * * *